US008820087B2

(12) United States Patent
Ryan

(10) Patent No.: US 8,820,087 B2
(45) Date of Patent: Sep. 2, 2014

(54) METHOD AND SYSTEM FOR CONTROLLING FUEL TO A DUAL STAGE NOZZLE

(75) Inventor: William R. Ryan, Oviedo, FL (US)

(73) Assignee: Siemens Energy, Inc., Orlando, FL (US)

( * ) Notice: Subject to any disclaimer, the term of this patent is extended or adjusted under 35 U.S.C. 154(b) by 1296 days.

(21) Appl. No.: 12/205,963

(22) Filed: Sep. 8, 2008

(65) Prior Publication Data

US 2010/0058770 A1 Mar. 11, 2010

(51) Int. Cl.

| | |
|---|---|
| ***F02C 7/22*** | (2006.01) |
| ***F02C 9/26*** | (2006.01) |
| ***F23R 3/34*** | (2006.01) |
| ***F23N 1/00*** | (2006.01) |
| ***F23D 11/38*** | (2006.01) |

(52) U.S. Cl.

CPC ..... *F23R 3/343* (2013.01); *F23N 2027/26* (2013.01); *F23N 1/002* (2013.01); *F23D 2900/00015* (2013.01); *F23N 2035/14* (2013.01); *F23D 11/38* (2013.01); *F23N 2035/28* (2013.01)

USPC ..... 60/739; 60/734; 60/740; 60/741; 60/742

(58) Field of Classification Search

USPC ..... 60/734, 739, 740, 741, 742, 772, 776

See application file for complete search history.

(56) References Cited

U.S. PATENT DOCUMENTS

| | | | | |
|---|---|---|---|---|
| 4,157,012 | A * | 6/1979 | DuBell | 60/39.465 |
| 4,337,616 | A * | 7/1982 | Downing | 60/39.281 |
| 4,499,735 | A | 2/1985 | Moore et al. | |
| 4,531,535 | A | 7/1985 | Kiernan et al. | |
| 4,903,478 | A * | 2/1990 | Seto et al. | 60/39.281 |
| 5,036,657 | A | 8/1991 | Seto et al. | |
| 5,329,759 | A | 7/1994 | Chan | |
| 5,339,636 | A | 8/1994 | Donnelly et al. | |
| 5,365,732 | A | 11/1994 | Correa | |
| 5,402,634 | A | 4/1995 | Marshall | |
| 5,423,175 | A | 6/1995 | Beebe et al. | |
| 5,442,922 | A | 8/1995 | Dyer et al. | |
| 5,448,882 | A | 9/1995 | Dyer et al. | |
| 5,881,550 | A | 3/1999 | Toelle | |
| 5,901,555 | A | 5/1999 | Mandai et al. | |
| 6,666,029 | B2 | 12/2003 | Ryan | |
| 6,786,049 | B2 | 9/2004 | Parsons et al. | |
| 6,857,272 | B2 | 2/2005 | Summerfield et al. | |
| 6,892,544 | B2 | 5/2005 | Futa, Jr. et al. | |
| 6,962,055 | B2 * | 11/2005 | Chen et al. | 60/746 |
| 7,024,862 | B2 | 4/2006 | Miyake et al. | |
| 7,036,302 | B2 * | 5/2006 | Myers, Jr. et al. | 60/39.281 |
| 7,188,476 | B2 * | 3/2007 | Inoue et al. | 60/737 |
| 2004/0079086 | A1 | 4/2004 | Smith et al. | |
| 2006/0101814 | A1 * | 5/2006 | Saitoh et al. | 60/377 |

* cited by examiner

*Primary Examiner* — Phutthiwat Wongwian

*Assistant Examiner* — Steven Sutherland

(57) ABSTRACT

A method and system for controlling delivery of fuel to a dual stage nozzle in the combustor of a gas turbine. A liquid fuel is conveyed from a single stage fuel supply through a plurality of primary fuel supply lines to a first nozzle stage including a plurality of primary nozzles. A predetermined operating condition of the gas turbine is identified and a signal is produced in response to the identified operating condition. The signal effects actuation of valves located on secondary fuel supply lines extending from each of the primary fuel supply lines to supply fuel to respective secondary nozzles.

19 Claims, 3 Drawing Sheets

METHOD AND SYSTEM FOR CONTROLLING FUEL TO A DUAL STAGE NOZZLE

FIELD OF THE INVENTION

The present invention relates generally to the field of gas turbine engine and, more particularly, to a fuel control system for supplying fuel to a dual stage nozzle.

BACKGROUND OF THE INVENTION

Gas turbines are well known and used in various applications. As illustrated in FIG. 1, a typical gas turbine engine 10 includes a compressor 12 which draws in ambient air 14 and delivers compressed air 16 to a combustor 18. A fuel supply 20 delivers fuel 22 to the combustor 18 where it is combined with the compressed air to produce high temperature combustion gas 24. The combustion gas 24 is expanded through a turbine 26 to produce shaft horsepower for driving the compressor 12 and a load such as an electrical generator 28. The expanded gas 30 is either exhausted to the atmosphere directly, or in a combined cycle plant, may exhausted to atmosphere through a heat recovery steam generator (not shown).

The fuel flow supplied to the combustor 18 from the fuel supply 20 will vary with variations in the operating condition of the engine 10, such as in the range of operation from ignition to full load. For example, in gas turbines fueled by a fuel oil, the fuel flow to the combustor 18 may be controlled with reference to a differential pressure at a fuel nozzle located with in the combustor 18 to ensure that proper fuel atomization occurs throughout the operating range of the engine.

In a known fuel delivery configuration, the pilot nozzles in a dry low NOx combustion system comprise a duel nozzle structure including a primary nozzle, defining a primary stage, and a secondary nozzle, defining a secondary stage. At lower loads and low fuel flow rates, all fuel is injected into the combustor through the primary stage, providing good atomization of the fuel. At higher loads, the fuel is injected through both the primary and the secondary stages to provide the required flow volume at moderate pressures. Specifically, in a known construction of a dual nozzle structure, a spring-loaded valve is provided in a fuel line between the primary and the secondary nozzles. As long as the differential pressure between the fuel supply pressure and the pressure in the combustion zone of the combustor is below a threshold value, the valve remains closed and all fuel flow goes through the primary stage. As the supply pressure increases, the fuel flow through the primary stage increases until the crack pressure of the valve is reached, and the valve opens to allow fuel flow to the secondary stage. The pressure differential for driving atomization of the fuel in the secondary stage is equal to the differential between the supply pressure and the combustion zone pressure, minus the crack pressure of the valve. Since this pressure differential at the secondary stage is very low just above crack pressure, i.e., just after the valve opens, the atomization of fuel injected through the secondary stage is typically less than optimum at this operating point.

In addition to the above-mentioned problems, pressure actuated valves may become stuck in either an open or closed position, and may experience a condition called "chatter" where the valve opens and closes rapidly in the operating region of the crack points, which may produce undesirable dynamics in the combustor.

FIG. 2 illustrates the flow characteristic curve for known pilot nozzles and depicts simplex (single nozzle) and pressure actuated duplex (dual nozzle) approaches. Line 4 illustrates the simplex nozzle flow where it is necessary to provide a high enough flow to meet base load flow requirements, resulting in less than optimum atomization at lower pressures. Two duplex approaches are also illustrated in FIG. 2, including different crack pressures, one at 600 psi and the other at 1000 psi. Line 6 depicts a first duplex approach in which the flow number ratio (secondary nozzle/primary nozzle) is 2:1. The flow condition depicted by line 6 comprises a crack pressure of 600 psi (point 5), where the secondary flow is initiated just before a full-speed-no-load (FSNL) condition. It may be seen that this is not desirable in that nozzle "chatter" may be a problem when idling at FSNL. Line 8 depicts a second duplex approach in which the crack pressure is increased to 1000 psi (point 7) which, while moving the line slightly above FSNL, may still be too close to FSNL to avoid problems in that the flow is not precisely known. As with the first approach, the pressure actuated valve providing the secondary flow will be subject to "chatter." Additionally, the flow number of the secondary nozzle in the second approach would need to be almost twice that of the secondary nozzle in the first approach in order to meet the base load fuel requirements, providing less than optimum atomization.

SUMMARY OF THE INVENTION

In accordance with one aspect of the invention, a method is provided for controlling delivery of fuel to a dual stage nozzle in the combustor of a gas turbine. The method comprises conveying a liquid fuel from a single stage fuel supply through a plurality of primary fuel supply lines at a predetermined rate; supplying the fuel from the primary fuel supply lines to a first nozzle stage comprising a plurality of primary nozzles associated with the primary fuel supply lines; identifying a predetermined operating condition of the gas turbine; and producing a signal in response to identifying the predetermined operating condition, the signal effecting actuation of a plurality of valves, each valve located on a secondary fuel supply line extending between one of the primary fuel supply lines and a respective secondary nozzle, the secondary nozzles forming a second nozzle stage.

In accordance with another aspect of the invention, a method is provided for controlling delivery of fuel to a dual stage nozzle in the combustor of a gas turbine. The method comprises providing a first nozzle stage comprising a plurality of primary nozzles; providing a second nozzle stage comprising a plurality of secondary nozzles, each secondary nozzle being associated with a respective primary nozzle to form nozzle pairs; conveying a liquid fuel from a single stage fuel supply through a plurality of primary fuel supply lines at a predetermined rate to each of the primary nozzles in the first nozzle stage; the second nozzle stage including a secondary fuel supply line from each of the primary fuel supply lines to one of the secondary nozzles, and each secondary fuel supply line including a valve; identifying a predetermined operating condition of the gas turbine; and producing a signal in response to identifying the predetermined operating condition, the signal effecting actuation of the valves whereby fuel from each primary fuel supply line is conveyed through the primary and secondary nozzles of a respective nozzle pair.

In accordance with a further aspect of the invention, a dual stage nozzle fuel control system is provided for providing fuel to the combustor section of a gas turbine. The system includes a first nozzle stage comprising a plurality of primary nozzles, and a second nozzle stage comprising a plurality of secondary nozzles, each secondary nozzle being associated with a respective primary nozzle to form a nozzle pair. A plurality of primary fuel supply lines are provided, where one of the primary fuel supply lines is connected to each of the primary nozzles. A single stage fuel supply is connected to the primary fuel supply lines for supplying fuel to each of the primary fuel lines. The second nozzle stage includes a secondary fuel supply line extending from each of the primary fuel supply lines to one of the secondary nozzles, and a valve is located in each of the secondary fuel supply lines between a respective secondary nozzle and a primary fuel supply line. A sensor is provided for identifying a predetermined operating condition of the gas turbine, and a controller is provided for producing a signal in response to identifying the predetermined operating condition. The signal effects actuation of the valves whereby fuel from each of the primary fuel supply lines is conveyed through the primary and secondary nozzles of a respective nozzle pair.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiment, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

Figure 1:
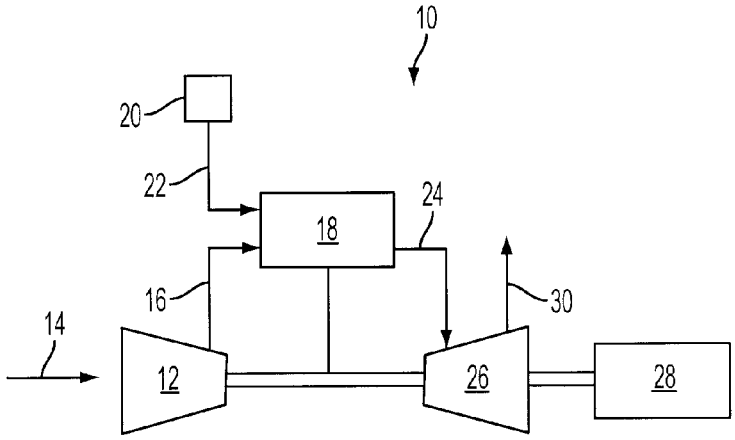
FIG. 1 PRIOR ART
FIG. 1 is a schematic illustration of a prior art gas turbine engine.
Figure 2:
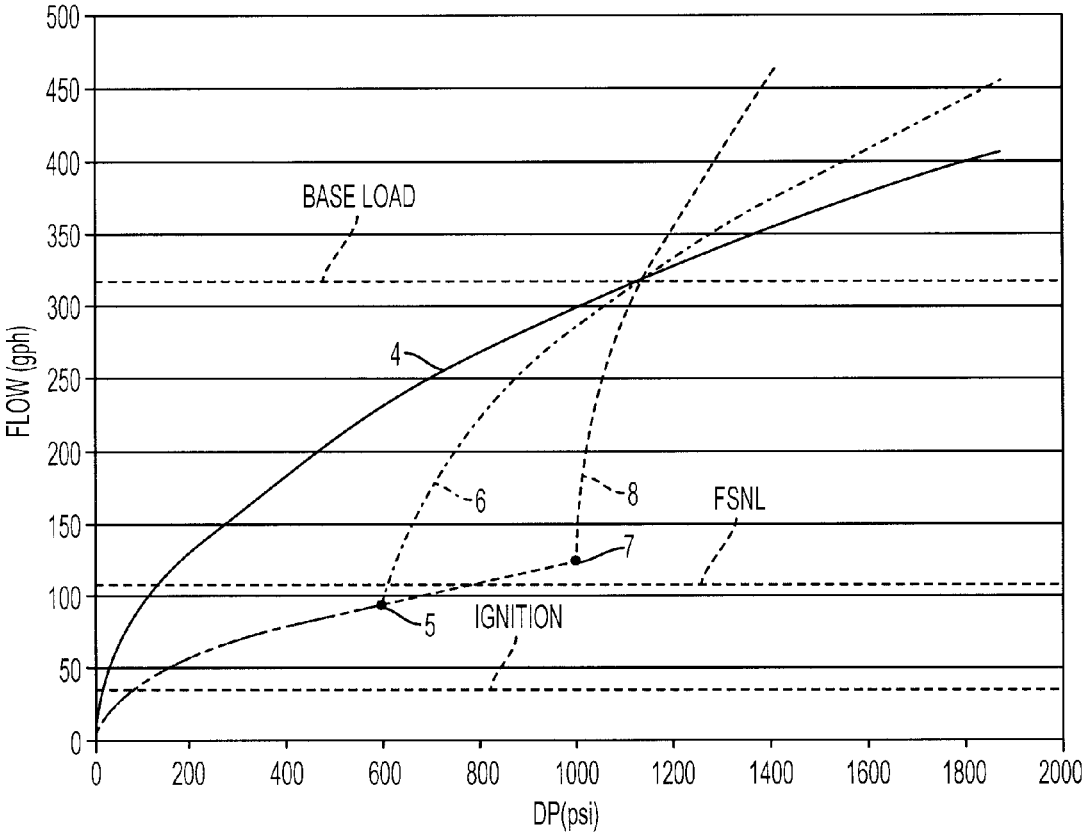
FIG. 2 PRIOR ART
FIG. 2 is a plot illustrating flow characteristics of prior art simplex and duplex nozzles.
Figure 3:
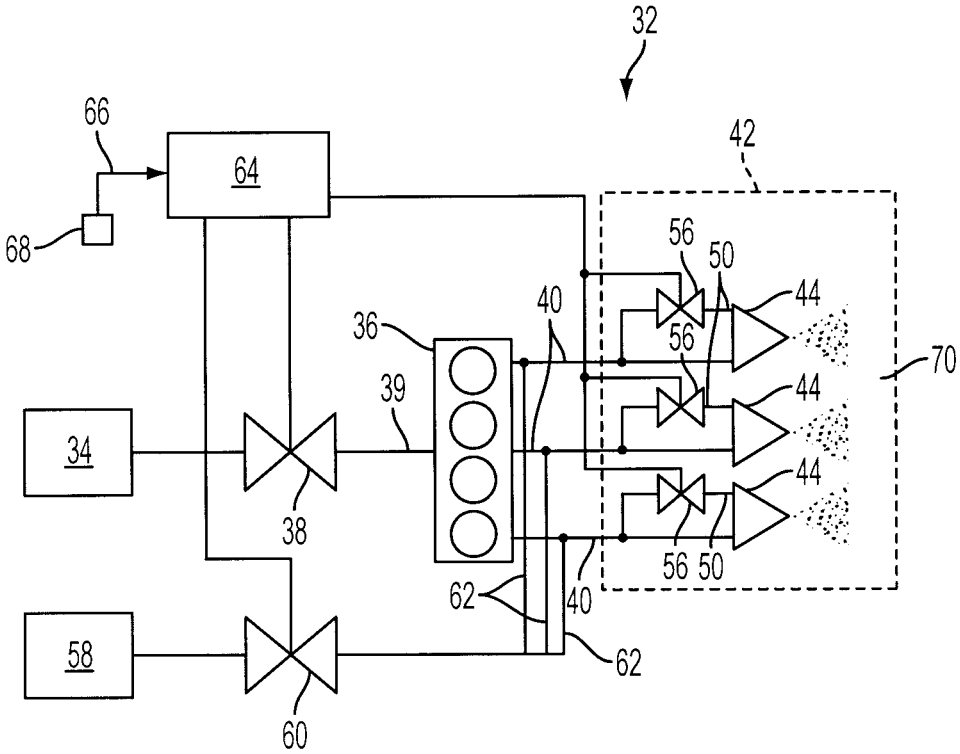
FIG. 3 is a schematic illustration of a dual stage nozzle fuel control system in accordance with the present invention.

The present invention provides a method and system for controlling fuel to a dual stage nozzle. Referring to FIG. 3, a system 32 in accordance with the present invention is illustrated and includes a fuel supply 34 pumping a liquid fuel, e.g., fuel oil, to a flow divider 36 via a fuel control valve 38 and fuel line 39. The flow divider 36 splits the fuel flow to a plurality of primary fuel supply lines or primary legs 40 (only three shown), such that fuel flow is provided to each of the primary legs 40 at a substantially identical flow rate. The flow divider 36 and primary legs 40 define a fuel stage for providing fuel flow to a combustion stage of a combustor 42. The flow divider 36 may be of a conventional design including metering spur gears for distributing fuel from a common inlet to a plurality of outlets, as is described in U.S. Pat. No. 4,531,535, which patent is incorporated herein by reference.

Figure 4:
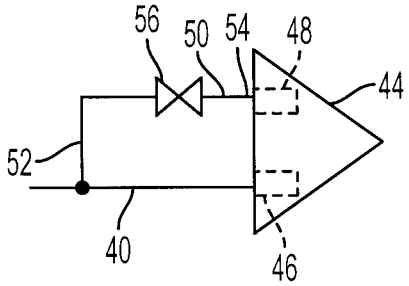
FIG. 4 is an enlarged schematic illustration of a duplex nozzle and associated fuel legs.

The primary legs 40 each supply fuel to a separate duplex fuel nozzle 44 where, for the purpose of the exemplary embodiment described herein, the duplex fuel nozzles 44 comprise pilot nozzles in a dry low NOx combustion system. Referring further to FIG. 4, the duplex fuel nozzles 44 each comprise a primary orifice or nozzle 46 and a secondary orifice or nozzle 48. The primary nozzles 46 and primary legs 40 form a primary nozzle stage for delivering fuel to the combustor 42 during a first operating condition of the engine. The secondary nozzles 48 and secondary legs 50 define a secondary nozzle stage for delivering fuel to the combustor 42 during a second operating condition of the engine.

A secondary fuel supply line or secondary leg 50 is connected to a respective one of each of the primary legs 40 at an inlet end 52, and connected to a respective one of the secondary nozzles 48 at an outlet end 54. The secondary nozzles 48 and secondary legs 50 define a secondary nozzle stage for delivering fuel to the combustor 42 during a second operating condition of the engine. Each of the secondary legs 50 includes a secondary valve 56 between the inlet end 52 and the outlet end 54 for providing control of fuel flow to the second nozzle 48. In a preferred embodiment, the secondary valve 56 comprises a solenoid actuated valve that may be operated in response to a predetermined sensed operating condition of the engine. Each primary nozzle 46 and associated secondary nozzle 48 form a nozzle pair that defines one of the duplex fuel nozzles 44.

The system 32 is further illustrated as including a water supply 58 providing water to each the of primary legs 40 via a water control valve 60 and water supply lines 62. The water control valve 60 may be used to provide a controlled amount of water to the fuel conveyed to the dual stage nozzles 44 to control combustion in a known manner, such as to control production of NOx during combustion.

It should be understood that although only three duplex fuel nozzles 44 and associated fuel legs 40, 50 are illustrated herein, a greater number of fuel nozzles 44 and fuel legs 40, 50 are typically provided, located around the circumference of the combustor 42. Further, regardless of the number of fuel nozzles 44 and fuel legs 40, 50, all of the primary fuel legs 40 are preferably provided with fuel from a single stage fuel supply comprising the single flow divider 36.

The operation of the fuel control valve 38, each of the secondary valves 56 and the water control valve 60 is controlled by a controller 64. The controller 64 may be of any known type, such as one comprising microprocessor control logic to produce a valve actuation signal for actuating the valves 38, 56, 60 to move to predetermined positions with reference to the operating conditions of the engine. In addition, one or more engine condition inputs 66 may be provided to the controller 64 via one or more sensors or by other input means, as is generally represented at 68. Such inputs 66 may include, for example, inputs for determining a differential pressure between the fuel legs 40, 50 and a combustion zone 70 of the combustor 42, inputs for determining a load on the engine, as well as any other inputs related to an operating condition of the engine.

The following description of the operation of the system is made with particular reference to one of the duplex fuel nozzles 44, as shown in FIG. 4. However, it should be understood that the description applies equally to the plurality of duplex fuel nozzles 44 in the combustor 42.

The system 32 described herein facilitates start-up and maintains a desired efficiency of the engine by controlling fuel flow to the duplex fuel nozzle 44 to improve atomization of fuel during various loads. In particular, the system 32 is operated with only the primary nozzle 46 supplying fuel to the combustor 42 during start-up, i.e., with the secondary valve 56 closed, and upon reaching a predetermined condition, such as a predetermined load or a predetermined differential pressure at the duplex fuel nozzle 44, the secondary valve 56 is actuated to additionally provide fuel to the combustor through the secondary nozzle 48. The flow numbers of primary nozzle 46 and the secondary nozzle 48 are selected such that the primary nozzle 46 provides adequate atomization of the fuel at low differential pressures, and the secondary nozzle 48 also provides adequate atomization at the differential pressure available in the fuel legs 40, 56 just after the secondary valve 56 opens. The flow number for each of the nozzles 46, 48 is defined as the ratio of the flow rate through the nozzle to the square root of the differential pressure across the nozzle.

Figure 5:
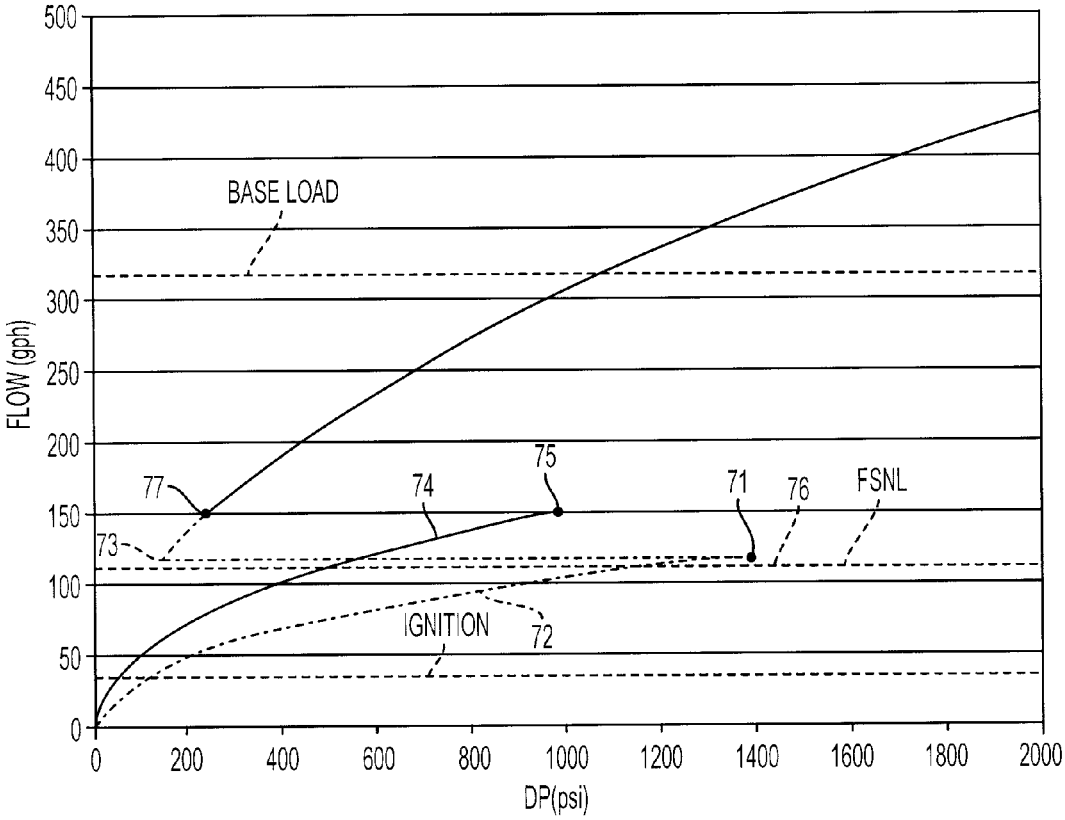
FIG. 5 is a plot illustrating the flow characteristics of an embodiment of the dual stage nozzle fuel control system in accordance with the present invention.

Referring to FIG. 5, two examples of fuel flow through the duplex nozzle 44 are illustrated In a first example of the duplex nozzle 44, depicted by line 72, the flow number of the secondary nozzle 48 is equal to twice the flow number of the primary nozzle 46, such that the flow number ratio is 2:1. It can be seen that the differential pressure increases relatively quickly to a predetermined differential pressure, i.e., approximately 1400 psi (point 73), at which time the secondary valve 56 is opened. When the secondary valve 56 opens, fuel flow is provided through both the primary nozzle 46 and the secondary nozzle 48 and the differential pressure drops, as illustrated by the differential pressure dropping to about 150 psi (point 73), with a subsequent increase in the flow and differential pressure up to a base load operating point.

In a second example of the duplex nozzle 44, depicted by line 74, the flow number of the secondary nozzle 48 is equal to the flow number of the primary nozzle 46, such that the flow number ratio is 1:1. As in the first example, the differential pressure increases relatively quickly to a predetermined differential pressure, i.e., approximately 1000 psi (point 75), at which time the secondary valve 56 is opened. When the secondary valve 56 opens, fuel flow is provided through both the primary nozzle 46 and the secondary nozzle 48 and the differential pressure drops, as illustrated by the differential pressure dropping to about 250 psi (point 77), with a subsequent increase in the flow and differential pressure up to the base load operating point.

In both of the above examples, as depicted by the lines 72 and 74 in FIG. 5, the system 32 may be operated to open the valves at moderate differential pressures, and provide good atomization from both nozzles 46, 48 at the time that the secondary valve 56 is actuated to open. However, the flow depicted by line 72 generally provides a better atomization than the flow depicted by line 74, and may be considered a preferred embodiment of the presently described examples.

Other flow number ratios may be selected within the scope of the present invention. The point at which the secondary valve 56 is opened should be selected to ensure that the differential pressure is sufficiently high to provide adequate atomization through both the primary nozzle 46 and the secondary nozzle 48 just after the secondary valve 56 opens. Further, it should be understood that although the above examples describe actuation of the secondary valve 56 with reference to a predetermined differential pressure, the condition for actuating the secondary valves may comprise a sensed engine condition. For example, in the first described example above (line 74), the secondary valve 56 may be actuated at or near sensing that a full speed no-load condition exists, as depicted by the line 76. Alternatively, the secondary valve 56 may be actuated when a predetermined load on the engine, such as 10% load, is identified by the controller 64.

The controller 64 additionally identifies a condition for closing the secondary valve 56, where the value of the measured parameter for closing secondary valve 56 is preferably lower than the value for opening the secondary valve 56. For example, if the secondary valve 56 is actuated to open at 10% load on the engine, the controller 64 may control the secondary valve 56 to close at a lower load value, such as 5% load on the engine. Similarly, if the differential pressure is the measured parameter for actuating the secondary valve 56, the differential pressure for actuating the closed position of the secondary valve 56 may be selected to be a predetermined value below the differential pressure for actuating the secondary valve 56 to the open position. By maintaining a dead-band between the opening and closing values, flow through the secondary nozzle 48 may be maintained during minor fluctuations, such as a drop in the differential pressure or engine load, thus avoiding repeated opening and closing, or "chatter," of the secondary valve 56 as the engine is brought up to full load.

Variations in the operation of the system 32 may be provided within the scope of the present invention. In particular, it may be necessary to actuate the secondary valves 56 in groups to avoid a potentially unstable fuel control problem that may result as the fuel control valve 38 is repositioned to compensate for the increase in fuel flow when the secondary valves 56 are opened. For example, instead of opening all of the secondary valves 56 at the same time upon sensing the predetermined condition, the secondary valves 56 may be opened in groups of two at predetermined time intervals, such as one group every second.

In addition, in the event that it is necessary to ensure that the secondary legs 50 are filled with fuel just after opening of the secondary valves 56, such as to ensure that a flameout does not occur immediately after the secondary valves 56 are opened, provision may be made for filling the portion of each of the secondary legs 50 between the secondary valve 56 and the secondary nozzle 48. This may be accomplished by providing the secondary leg 50 with an orifice, such as a designed "leak" in the secondary valves 56, to fill the secondary leg 50. Alternatively, the secondary valves 56 may be actuated to open slowly to ensure that the differential pressure at the primary nozzle 46 is maintained as the secondary leg 50 fills.

The method and system for controlling the fuel flow to the duplex nozzles 44 ensures that good atomization occurs at any operating point of the engine. In particular, the operation of the duplex nozzles 44 ensures good atomization just after flow to the secondary nozzles 48 is initiated, thus avoiding problems experienced in known fuel delivery systems such as those incorporating pressure actuated valves to provide fuel flow to secondary nozzles.

Further, the present invention provides a system 32 in which a single stage fuel supply, comprising a single flow divider 36, provides a controlled fuel flow to both stages, i.e., primary and secondary stages, of the dual fuel nozzle system. Hence, the present system 32 avoids the complexity and expense of providing multiple flow dividers, valves and controls, i.e., one for each nozzle stage, to ensure adequate control of fuel flow to each of the nozzle stages.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method of controlling delivery of fuel to a plurality of duplex nozzles in the combustor of a gas turbine, each duplex nozzle including a primary orifice and a secondary orifice defining an orifice pair, the method comprising:

providing a flow divider having a single fuel inlet and a plurality of fuel outlets, the flow divider providing a separate positive displacement of fuel to each of the outlets, metering an equal fuel flow in tandem to each of the fuel outlets;

providing a single primary fuel supply line connected to each fuel outlet of the flow divider, wherein each primary fuel supply line is separated from fluid communication with any other primary fuel supply line;

conveying a liquid fuel from the fuel outlets through each respective primary fuel supply line at a predetermined rate;

supplying the fuel from each primary fuel supply line to the primary orifice of a respective duplex nozzle;

providing a secondary fuel supply line for each primary fuel supply line, each secondary fuel supply line having an inlet connected to a respective primary fuel supply line between the primary orifice in a respective duplex nozzle and the connection of the primary fuel supply line to a respective fuel outlet of the flow divider, wherein each secondary fuel supply line extends from a respective primary fuel supply line to a secondary orifice in the respective duplex nozzle;

providing a valve between the connection of each secondary fuel supply line to a respective primary fuel supply line and a respective secondary orifice;

identifying a predetermined operating condition of the gas turbine; and producing a valve actuating signal in response to identifying the predetermined operating condition, the valve actuating signal effecting actuation of the valves in the secondary fuel supply lines from a closed position to an open position whereby, for each orifice pair, fuel from each primary fuel supply line is conveyed through both the secondary orifice and the primary orifice located in the respective duplex nozzle.

2. The method of claim 1, wherein the flow divider provides a positive displacement of fuel to each of the plurality of primary fuel supply lines to provide fuel at a substantially identical predetermined flow rate.

3. The method of claim 1, wherein the actuation of the valves located on the secondary fuel lines comprises opening of the valves and, following actuation of the valves, a differential pressure at each of the secondary orifices is substantially equal to a differential pressure at the respective first orifice.

4. The method of claim 3, wherein actuation of the valves causes a predetermined decreased differential pressure in the primary fuel supply lines, the decreased differential pressure being above a minimum pressure for effecting atomization of the liquid fuel through both the first orifice and the second orifice.

5. The method of claim 1, wherein the predetermined operating condition comprises a predetermined load on the gas turbine.

6. The method of claim 5, wherein the actuation of the valves located on the secondary fuel lines comprises opening of the valves, and the valves are actuated to close at a second predetermined load on the gas turbine lower than the predetermined load to open the valves.

7. The method of claim 1, wherein the predetermined operating condition comprises a predetermined differential pressure between a pressure in the primary fuel supply lines and a pressure in a combustion zone of the combustor.

8. The method of claim 7, wherein the actuation of the valves located on the secondary fuel lines comprises opening of the valves, and the valves are actuated to close at a second predetermined differential pressure substantially lower than the predetermined differential pressure to open the valves.

9. A method of controlling delivery of fuel to a dual stage nozzle in the combustor of a gas turbine, the method comprising:

providing a first nozzle stage comprising a plurality of primary orifices;

providing a second nozzle stage comprising a plurality of secondary orifices, each secondary orifice being associated with a respective primary orifice to form duplex nozzle pairs;

conveying a liquid fuel from a single stage fuel supply through a plurality of primary fuel supply lines at a predetermined rate to each of the primary orifices in the first nozzle stage;

the second nozzle stage including a secondary fuel supply line from each of the primary fuel supply lines to one of the secondary orifices, and each secondary fuel supply line including a valve;

identifying a predetermined operating condition of the gas turbine; and producing a valve actuating signal in response to identifying the predetermined operating condition, the valve actuating signal effecting a sequential actuation of selected groups of valves at predetermined time intervals wherein each selected valve group is defined by a number of valves less than the total number of secondary fuel supply lines and each selected valve group is opened from a closed position at a predetermined time interval following the opening of a prior valve group whereby fuel from each primary fuel supply line is conveyed through corresponding groups of secondary orifices at the predetermined time intervals and wherein the fuel from each primary supply line is also conveyed through the primary orifices.

10. The method of claim 9, wherein the single stage fuel supply comprises a single flow divider, each primary fuel supply line connected to the flow divider and receiving a separate fuel supply from the flow divider, and wherein the flow divider provides a positive displacement of fuel to each of the plurality of primary fuel supply lines to provide fuel at a substantially identical predetermined flow rate.

11. The method of claim 10, wherein the actuation of the valves located on the secondary fuel lines comprises opening of the valves and, following actuation of the valves, a differential pressure at each of the secondary orifices is substantially equal to a differential pressure at the respective first orifice.

12. The method of claim 10, wherein the predetermined operating condition comprises a predetermined differential pressure between a pressure in the primary fuel supply lines and a pressure in a combustion zone of the combustor.

13. The method of claim 12, wherein the actuation of the valves located on the secondary fuel lines comprises opening of the valves, and the valves are actuated to close at a second predetermined differential pressure substantially lower than the predetermined differential pressure to open the valves.

14. The method of claim 9, wherein the predetermined operating condition comprises a predetermined load on the gas turbine.

15. The method of claim 14, wherein the actuation of the valves located on the secondary fuel lines comprises opening of the valves, and the valves are actuated to close at a second predetermined load on the gas turbine lower than the predetermined load to open the valves.

16. The method of claim 9, wherein each of the valves comprises a solenoid valve.

17. A dual stage nozzle fuel control system for providing fuel to the combustor section of a gas turbine, said system comprising:

a first nozzle stage comprising a plurality of primary orifices;

a second nozzle stage comprising a plurality of secondary orifices, each secondary orifice being associated with a respective primary orifice to form an orifice pair located within a duplex nozzle;

a plurality of primary fuel supply lines, one of the primary fuel supply lines connected to each of the primary orifices;

a flow divider having a single fuel inlet and a plurality of fuel outlets, the flow divider providing a separate positive displacement of fuel to each of the outlets, metering an equal fuel flow in tandem to each of the fuel outlets, wherein a single one of the primary fuel supply lines is connected to each fuel outlet of the flow divider, and each primary fuel supply line is separated from fluid communication with any other primary fuel supply line;

the second nozzle stage including a secondary fuel supply line extending from each of the primary fuel supply lines to one of the secondary orifices, each secondary fuel supply line having an inlet connected to a respective primary fuel supply line between the primary orifice in a respective duplex nozzle and the connection of the primary fuel supply line to a respective fuel outlet of the flow divider, wherein each secondary fuel supply line extends from a respective primary fuel supply line to a secondary orifice in the respective duplex nozzle;

a valve located in each secondary fuel supply line between a respective secondary orifice and a respective primary fuel supply line;

a sensor for identifying a predetermined operating condition of the gas turbine; and a controller for producing a valve actuating signal in response to identifying the predetermined operating condition, the valve actuating signal effecting actuation of the valves in the secondary fuel supply lines from a closed position to an open position whereby, for each orifice pair, fuel from each primary fuel supply line is conveyed through both the secondary orifice and the primary orifice located in a duplex nozzle.

18. The system of claim 17, wherein the flow divider provides a positive displacement of fuel to each of the plurality of primary fuel supply lines to provide fuel at a substantially identical predetermined flow rate.

19. The system of claim 18, wherein each of the valves comprises a solenoid valve.

* * * * *